US005993195A

United States Patent [19]

Thompson

[11] Patent Number: 5,993,195

[45] Date of Patent: Nov. 30, 1999

[54] COMBUSTION AIR REGULATING APPARATUS FOR USE WITH INDUCED DRAFT FURNACES

[75] Inventor: Kevin D. Thompson, Indianapolis, Ind.

[73] Assignee: Carrier Corporation, Farmington, Conn.

[21] Appl. No.: 09/049,415

[22] Filed: Mar. 27, 1998

[51] Int. Cl.[6] ..... F23N 5/24; F23N 11/44; F24H 3/00

[52] U.S. Cl. ..... 431/19; 431/12; 431/20; 126/116 A

[58] Field of Search ..... 431/19, 12, 20, 431/89, 114; 126/116 A

[56] References Cited

U.S. PATENT DOCUMENTS

| | | | |
|---|---|---|---|
| 1,992,048 | 2/1935 | Temple | 236/25 R |
| 2,261,904 | 11/1941 | McDermott | 431/20 |
| 2,332,580 | 10/1943 | Klinker | 236/14 |
| 3,042,769 | 7/1962 | Campbell | 431/20 |
| 4,102,627 | 7/1978 | Reed et al. | 431/20 |
| 4,182,483 | 1/1980 | Swenson | 431/20 |
| 4,251,025 | 2/1981 | Bonne et al. | 431/12 |
| 4,279,207 | 7/1981 | Wormser . | |
| 4,550,874 | 11/1985 | Clouser et al. | 431/20 |
| 4,703,747 | 11/1987 | Thompson et al. | 126/112 |
| 4,708,636 | 11/1987 | Johnson | 431/20 |
| 4,846,400 | 7/1989 | Crouse | 431/20 |
| 5,309,890 | 5/1994 | Rieke et al. . | |
| 5,331,944 | 7/1994 | Kujawa et al. . | |
| 5,341,795 | 8/1994 | Chou et al. . | |
| 5,379,749 | 1/1995 | Rieke et al. . | |
| 5,395,230 | 3/1995 | Ferguson | 431/12 |

OTHER PUBLICATIONS

North American Combustion Handbook, vol. II, 3d edition, pp. 46 through 60.

*Primary Examiner*—Ira S. Lazarus
*Assistant Examiner*—David Lee
*Attorney, Agent, or Firm*—Wall Marjama Bilinski & Burr

[57] ABSTRACT

A combustion air regulating apparatus which is adapted for use with two stage induced draft furnaces and which allows such furnaces to be used with low cost AC inducer motors of the type having one or a small number of nominally fixed operating speeds. A flow restrictor assembly is disposed in fluidic series with the air intake and the exhaust vent to controllably restrict the flow of air through the burner box when the inducer motor operates at its low speed. A pressure sensing assembly is connected to sense a pressure approximately equal to that across the heat exchanger, and to control the flow resistance of the flow restrictor assembly to maintain a sufficient level of excess air when the furnace operates in its low stage. A solenoid valve responsive to the establishment of high stage furnace operation causes the flow restrictor assembly to establish and maintain its minimum flow resistance during operation in that stage.

30 Claims, 4 Drawing Sheets

COMBUSTION AIR REGULATING APPARATUS FOR USE WITH INDUCED DRAFT FURNACES

BACKGROUND OF THE INVENTION

The present invention relates to a combustion air regulating apparatus for use with induced draft furnaces, and is directed more particularly to a combustion air regulating apparatus which is suitable for use with single and multi stage induced draft furnaces that include inducer motors which have one or more non-adjustable operating speeds.

In the operation of an induced-draft gas-fired furnace, combustion efficiency can be optimized by maintaining the proper ratio of the gas input rate and the combustion air flow rate. Generally, the ideal ratio is offset somewhat for safety purposes by providing for slightly more combustion air (i.e., excess air) than that required for optimum combustion efficiency conditions. In order that furnace heat losses are minimized, it is important that this excess air level is controlled.

In practice, the rate of combustion excess air flow is affected by a number of factors including vent length, furnace size, and wind conditions. Although furnace size may be predetermined at the factory, vent length is commonly not known until actual installation time, and wind conditions are normally highly variable during operation of the furnace. Additional conditions such as partial blockages by debris of various kinds can also affect combustion excess air flow rate while the furnace is in operation.

In addition, a large number of different furnace models are commonly in use at present, and it is highly desirable to provide an apparatus which can be used with a variety of different furnace models currently in use, as well as those that may be manufactured in the fixture. More specifically, it is desired to have a way of controlling excess air in single and multi stage furnaces of both the condensing and non-condensing types.

One method for controlling excess air in 2 stage induced draft furnaces having a fixed-firing rate is described in U.S. Pat. No. 4,729,207 (Dempsey et al). This patent teaches a method of air combustion regulation which makes use of a variable speed electronically commutated motor or ECM that is used in conjunction with a physically separate electronic control network. A method of combustion air regulation which makes use of a variable speed inducer motor having an integrated or built-in, software based electronic controller is described in U.S. Pat. No. 5,331,944 (Kujawa et al). Both of the latter patents are assigned to the assignee of the present invention, and both are incorporated by reference herein.

Another way of controlling excess air in induced draft furnace is to provide an air/fuel ratio control system. In systems of this type the rate of flow of combustion air and the rate of flow of fuel are so coupled to one another that changes in one rate of flow cause corresponding changes in the other rate of flow, thereby maintaining a constant percentage of excess air. In one system of this type, called a fuel primary system, the input controller controls the rate of fuel flow and the rate of flow of air is adjusted as necessary to maintain the desired excess air level, usually by means of butterfly valves that are controlled by transmitter-controller devices. In another system of this type, called an air primary system, the input controller controls the rate of air flow and an air/fuel rates controller causes the rate of fuel flow to be adjusted as necessary to maintain the desired excess air level. Systems of these types are described in greater detail in the "North American Combustion Handbook", third edition, volume II, pages 46–60.

While the safety aspect of excess air control is equally significant in residential and commercial heating applications, initial cost and fuel efficiency considerations often call for the use of different excess air control system for these different applications. This is because the fuel savings resulting from accurate excess air control in commercial heating applications are so much greater than those resulting from accurate excess air control in residential applications. As a result, furnaces that heat commercial buildings usually use excess air control systems of the above-described air/fuel ratio control type; and justify their higher initial cost on the basis of their greater efficiency. Some furnaces that heat homes, on the other hand, have usually controlled excess air levels by using one of the above-described types of variable speed inducer motor control systems. While the cost of these variable speed inducer motor control systems is less than that of air/fuel ratio control systems, that cost is still substantial.

Prior to the present invention, attempts to reduce the cost of excess air control systems of the variable speed motor type by replacing those inducer motors and their associated speed controllers with inexpensive motors having one or a small number of non-adjustable speeds have not been very successful at controlling excess air. One reason is that such systems still require controllers to select among the various non-adjustable speeds. Another is the fact that, particularly at their lower speeds, such motors have poor low speed operating characteristics. This in turn, caused the excess air level to fluctuate to an unacceptable degree as a result of variations in operating conditions, such as line voltage, wind speed and installed vent length.

SUMMARY OF THE INVENTION

In accordance with the invention, there is provided an improved combusting air regulating apparatus which provides accurate control over excess air levels, and yet which does not require the use of air/fuel ratio controllers or the use of variable speed inducer motors.

A common feature of all embodiments of the regulating apparatus of the present invention is use of a low cost AC inducer motor of the type having one or a small number of nominally fixed operating speeds, in combination with a combustion air flow regulator device which varies the rate of flow of air into the combustion air intake or out of the exhaust vent, at at least the lowest motor speed, as necessary to maintain the desired excess air level. This is accomplished by means of a pressure sensing assembly that controls the air flow regulator in accordance with a pressure that approximates the pressure difference across the heat exchanger of the furnace. In non-condensing furnaces this pressure difference may be measured at any of a variety of locations that are in proximity to or at least at approximately the same pressures as the inlet and outlet ends of the heat exchanger. In condensing furnaces, this pressure difference may be measured between the collector box and either the inlet end of the heat exchanger or a suitable location within the air flow regulator itself In all embodiments, the air flow regulator and pressure sensing assembly cooperate to vary the flow of combustion air in a way that compensates for inducer motor speed fluctuations of the type that are common in low cost AC motors that have non-adjustable operating speeds.

Advantageously, the excess air control apparatus of the invention may be used with furnaces having one, two or even more stages, or firing rates. In single stage furnaces, the apparatus operates continuously, in spite of inducer motor speed fluctuations, to maintain the desired excess air level. In two or more stage furnaces, the apparatus is active during operation at at least the lowest stage. When the furnace operates in its low stage, the invention operates as a continuously variable proportional controller to maintain the desired excess air level. When, however, the furnace operates in one or more stages higher than its lowest stage, the apparatus of the invention is deactivated. During operation in this deactivated or high stage mode, the apparatus automatically establishes a condition of minimum flow resistance, thereby establishing a rate of flow of combustion air which assures that acceptable levels of excess air are maintained.

In preferred embodiments of the invention changes in operating mode are associated with changes to high stage. The furnace control switches the inducer and blower to high speed, then activates the high stage circuit. In a two stage condensing furnace, the high stage circuit is activated by a relay on the furnace control which energizes a solenoid operated valve to decouple the pressure sensing assembly from the collector box, and thereby prevent the flow regulator from reducing the rate of flow of air through the burner box. Other methods, however, may be used to control the operating mode of the apparatus of the invention without departing from the more general aspects of the control scheme contemplated thereby.

The flow control or restricting portion of the excess air control apparatus of the invention may have any of a variety of different physical configurations. In preferred embodiments, the flow control/restricting assembly comprises a flow-through chamber or duct within which is disposed a movable restrictor member, such as a hinged plate or a poppet, together with a suitable fixed restrictor member having an orifice of suitable size. During operation, the position of the movable restrictor member is controlled by a pressure sensing assembly through a movable connecting member. Together with the fixed restrictor member, the movable member defines a controllable flow resistance through which combustion air must flow on its way to or from the burner box, and thereby controls the rate of flow of air to the burner box. Since the rate of flow of fuel to the burner box is controlled by the furnace, independently of the rate of flow of combustion air, this flow resistance itself directly determines the excess air level of the furnace. In accordance with the invention, the pressure sensing assembly causes this flow resistance to track the negative pressure differential across the heat exchanger, and thereby automatically maintain the excess air level at the desired value.

DESCRIPTION OF THE DRAWINGS

Other objects and advantages will be apparent from the following description and drawings, in which.

DESCRIPTION OF THE PREFERRED EMBODIMENTS

Figure 1:
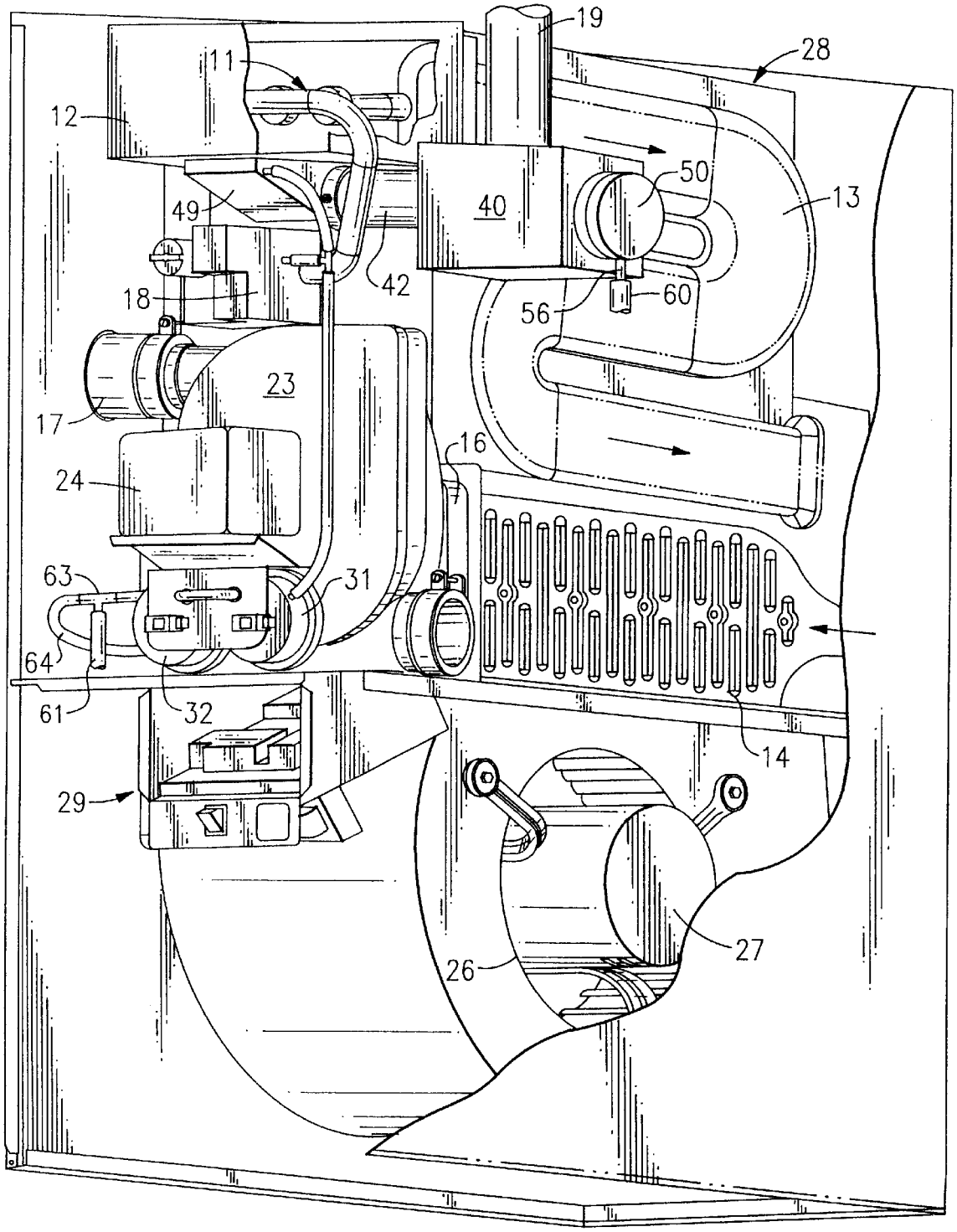
FIG. 1 is a cutaway oblique view of a two-stage condensing furnace that includes an excess air control apparatus constructed in accordance with the present invention.

Referring now to FIG. 1, there is shown a furnace of one of the general types with which the present invention can be employed, namely a two-stage condensing furnace i.e., a condensing furnace which has two firing rates. A burner assembly 11 communicates with a burner box 12 to a primary heat exchanger 13. Fluidly connected at the other end of the primary heat exchanger 13 is a condensing heat exchanger 14 whose discharge end is fluidly connected to a collector box 16 and an exhaust vent 17. In operation, gas valve 18 meters the flow of gas to the burner assembly 11 where combustion air from the air inlet 19 is mixed and ignited by an igniter assembly not shown. The hot gas is then passed through the primary heat exchanger 13 and the condensing heat exchanger 14, as shown by the arrows. The relatively cool exhaust products are vented to the atmosphere via vent 17, while the condensate flows from the collector box 16 through a condensate drain line (not shown) from where it is drained to a sewer line or the like. The flow of the combustion air into the air inlet 19 through the heat exchangers 13 and 14, and the exhaust through vent 17, is enhanced by a draft inducing blower 23 which is driven by an inducer motor 24 in response to control signals from the furnace control assembly 29 and pressure switches 31 and 32. Unlike previously known furnaces, which use variable speed inducer motors, the furnace of FIG. 1 uses an inexpensive AC motor which has only one or a small number of nominally fixed operating speeds. Inducer motor 24 may, for example, comprise a PSC split capacitor AC motor.

The household air is drawn into a blower 26 which is driven by a drive motor 27, in response to signals received from either its own internal microprocessor, or the furnace control contained in the furnace control assembly 29, or a combination of both. The discharge air from the blower 26 passes over the condensing heat exchanger 14 and the primary heat exchanger 13, in counterflow relationship with the hot combustion gases, to thereby heat up the household air, which then flows from the discharge opening 28 to the duct system of the space to be heated.

Figure 2:
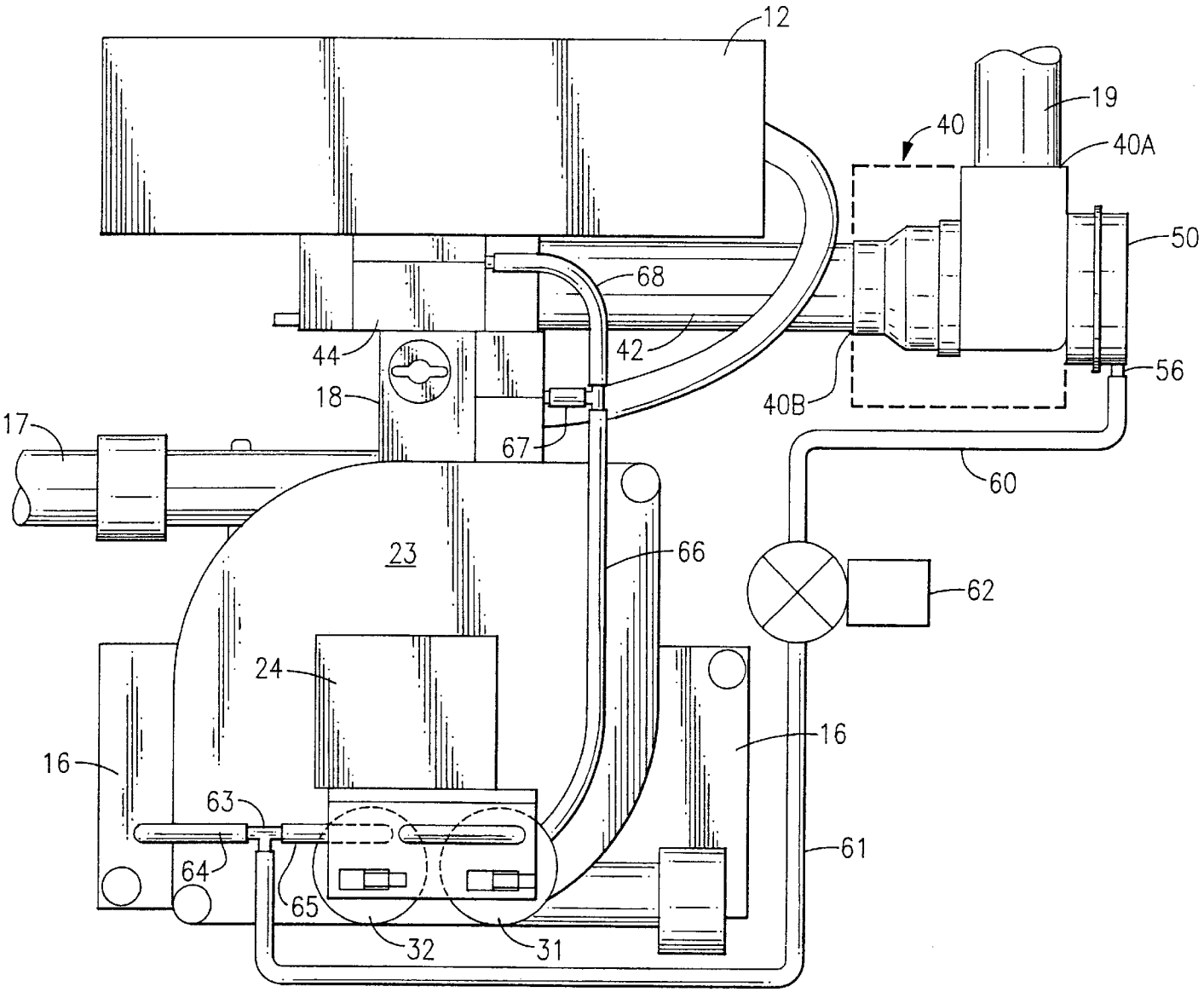
FIG. 2 is a simplified partial front view of the furnace of FIG. 1.

In accordance with the present invention, there is provided a flow control assembly 40 and a pressure sensing assembly 50 which together control the rate at which combustion air is supplied to burner box 12. In the embodiment of FIGS. 1 and 2, flow control assembly 40 is connected between intake 19 the inlet end of burner box 12 through a duct 42 and a combustion air intake box 49. More generally, however, flow control assembly 40 can be positioned at any other convenient location, such as between inducer blower 23 and exhaust vent 17, which is in fluidic series between intake 19 and vent 17.

In operation, flow control assembly 40 controls the rate of flow of combustion air by establishing a variable flow resistance between its inlet end 40A and its outlet end 40B. The magnitude of this flow resistance is determined by a pressure sensing assembly 50, which is mounted adjacent and in control relationship to flow control assembly 40. In accordance with the present invention, sensing assembly 50 is arranged to sense a pressure that is approximately equal to the pressure drop across the heat exchanger assembly, and to use that pressure difference to vary the flow resistance established by a flow control assembly 40 as necessary to cause the excess air level of the furnace to remain approximately at the desired value, in spite of changes in the operating conditions of the furnace, such as those caused by changing wind conditions on air flow into intake 17. These changes in operating condition may include those associated with the poor low speed operating characteristics of motor 24.

Figure 3:
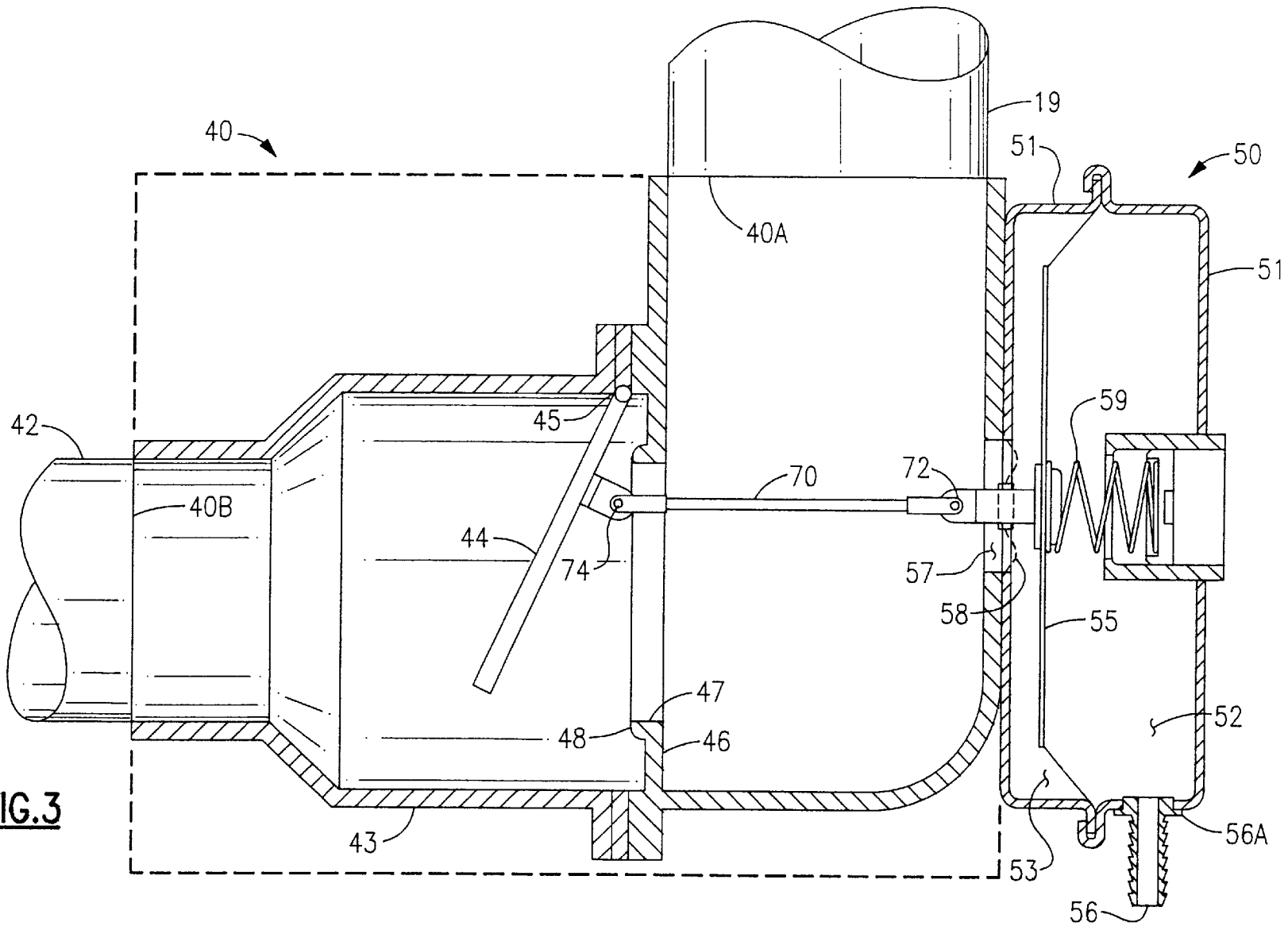
FIG. 3 is a cross sectional view of one flow control assembly and one pressure sensing assembly of a type that is suitable for use with the present invention.

One exemplary embodiment of the flow control assembly and pressure sensing assembly of the combustion air regulating apparatus of the invention is shown in FIG. 3. In FIG. 3, flow control assembly 40 includes a flow through chamber or duct 43, a first, movable restrictor member 44 here comprising a plate rotatably supported on a hinge 45, and a fixed restrictor plate 46 having an opening 47 one end of which defines a seat 48 that faces plate 44. Pressure sensing assembly 50 includes a housing 51 that encloses two chambers 52 and 53 which are separated by a flexible diaphragm 55. Chamber 52 communicates with a first pressure inlet 56, and chamber 53 communicates with a second pressure inlet 57 which, in the present embodiment comprises an opening through the sidewall of housing 51. Pressure sensing assembly 50 also includes an adjustment spring 59 which is secured within a suitable adjustment housing. Because sensing assembly 50 is of a type that is well known to those skilled in the art, it will not be described in detail herein.

Flow control assembly 40 and pressure sensing assembly 50 are operatively coupled to one another by a connecting member 70 which, in the embodiment of FIG. 3, passes through pressure inlet opening 57. In the event that it is desirable for diaphragm 55 to be isolated from the air in duct 43, opening 57 may be closed by a smaller flexible diaphragm seal 58 (shown in dotted lines in FIG. 3). As a result chamber 53 would require a different pressure inlet, not shown. Connecting member 70 preferably comprises a connecting arm or linkage having a first end that is pivotally attached to diaphragm 55 by a pin 72 and a second end that is pivotally attached to restrictor plate 44 by a pin 74. As a result of these connections, the leftward movement of diaphragm 55 tends to swing plate 44 into its open position, while the rightward movement of diaphragm 55 tends to swing plate 44 toward its closed position. It will therefore be seen that the position of diaphragm 55 controls the magnitude of the flow resistance between members 44 and 46 and, therefore, the rate at which combustion air flows through burner box 12. As will be explained presently in connection with FIG. 2, this flow resistance is controlled in accordance with a pressure drop that approximates the pressure drop across the two parts of the heat exchanger, thereby assuring that the desired excess air level is maintained in spite of the fact that the speed of inducer motor is not controllable and fluctuates significantly, particularly when the furnace operates in its low stage.

In accordance with the invention, the above-described results are produced by connecting the two pressure inlets 56 and 57 of pressure sensing assembly 50 to parts of the furnace that are at pressures approximately equal to the pressures at the inlet and outlet ends of the heat exchanger assembly. In the embodiment of FIGS. 1–3, best shown in FIG. 2, this is accomplished in part by connecting first or low pressure inlet 56 of sensor 50 to collector box 16 through pressure tubes 60 and 61, a solenoid valve 62 (which will be discussed more fully later), a T-connector 63, and a pressure tube 64. As is best shown on FIG. 3, this is also accomplished in part by exposing second or high pressure inlet opening 57 of sensing assembly 50 to the interior of flow control assembly 40, which approximates the pressure at the inlet end of the heat exchanger. As will be clear from FIGS. 4A–4C, however, these connections of the pressure inlets of pressure sensing assembly 50 are exemplary only.

The operation of the excess air control apparatus of the invention in a two stage furnace will now be described with reference to FIGS. 1 and 2. When the furnace is operating in its low stage, the pressure difference across the heat exchanger, as measured between collector box 16 and pressure inlet opening 57 is conveyed through solenoid valve 62 which is in its normally open state and approximates the same pressure difference that appears across diaphragm 55 of pressure sensing assembly 50. If this pressure difference is relatively high, indicating that the rate of flow of combustion air is too high, diaphragm 55 moves to the right as shown in FIG. 3 and increases the flow resistance established by flow control assembly 40. Conversely, if this pressure difference is too low, indicating that the rate of flow of combustion air is too low, diaphragm 55 moves to the left and decreases the flow resistance established by flow control assembly 40. In this way, the flow resistance presented to the combustion air is automatically varied as necessary to maintain the desired excess air level, even as effects such as wind and variations on the speed of the inducer motor change in an unpredictable manner.

In order for the apparatus of the invention to act as a proportional controller during low stage operation, it is desirable for certain dimensional relationships to exist between plate 44, the length of connecting arm 70 and the length of the lever between pin 74 and hinge 45. In particular, it is desirable for the relationships between these dimensions be such that during low stage operation, restrictor member 44 remains free to move as diaphragm 55 moves through approximately its entire range of motion. This assures that member 44 completely closes off orifice 47 when the pressure at inlet 56 reaches its most negative value, and assumes its most fully open position when the pressure at inlet 56 reaches its least negative value. Stated differently, it is desirable for the subject dimensional relationships to be such that the flow resistance established by assembly 40 during low stage operation remains between predetermined maximum and minimum values. Because the manner of determining these dimensional relationships will be apparent to those skilled in the art, this determination will not be further described herein.

When the furnace is caused to operate in its high stage, the solenoid valve 62 is closed, thereby interrupting fluidic communication between collector box 16 and low pressure inlet 56 of pressure sensing assembly 50. After this interruption occurs, a bleed hole 56A in inlet 56, best shown in FIG. 3, gradually allows the pressure within sensor chamber 52 to rise to that of the ambient air pressure within the furnace. This, in turn, causes diaphragm 55 and connecting member 70 to move restrictor member 44 to its fully open position, thereby causing assembly 40 to present its lowest possible resistance to the flow of combustion air. In accordance with the invention, the dimensional relationships of the restrictor member 44 and the lever arm between pin 74 and hinge 45 are chosen so that this flow resistance is at a minimum, thus allowing the maximum excess air levels in the furnace to be provided throughout the period of high stage furnace operation. During high stage operation, load related inducer motor speed fluctuations are much smaller than those which occur during low stage operation, and therefore do not require an excess air control.

The excess air regulating apparatus of the invention is easily adapted for use with single stage furnaces. In such furnaces, there is no high stage operating mode. As a result, the rate of flow of combustion air must be continuously adjusted if optimum excess air levels are to be maintained. The present invention is easily adapted for use with such furnaces by simply eliminating solenoid valve 62 and connecting pressure tube 61 directly to first pressure inlet 56 of pressure sensing assembly 50. Because the operation of the apparatus of the invention in this mode is the same as that described in connection with the low stage operation of the embodiment of FIGS. 1–3, operation in this mode will not be described again herein.

The excess air regulating apparatus of the invention may also be adapted for use with furnaces having more than two stages. One way to do this is simply to apply a two-position solenoid valve to the adjustment housing which would provide two set points for the adjustment spring 59 and would accommodate three stages of excess air control. Another way to adapt the apparatus of the invention for operation with furnaces having more than two stages is to apply a modulating solenoid valve to the adjustment housing which would provide multiple set points for adjustment spring 59 and would accommodate multiple levels of excess air control. Other variations could, at significantly greater cost, employ multiple flow control assemblies in series or parallel. Because the construction of such multi-stage variants will be apparent to those skilled in the art, they will not be further discussed herein.

The physical configuration, location and connections of the flow control assembly and pressure sensing assembly of the embodiment of FIGS. 1–3 comprise only one example of the many possible configurations, locations and connections that may be used in practicing the present invention. The flow control assembly and pressure sensing assembly may, for example, be located fluidically downstream rather then fluidically upstream of the burner box, provided that the pressure inlets of the sensing assembly are connected to parts of the furnace that are at pressures approximately equal to those at the inlet and outlet ends of the heat exchanger or pressures that are commensurate to a constant flow. In such embodiments the pressure sensing assembly is preferably of the type that includes two discrete pressure inlet fittings, such as inlet fitting 56 of pressure sensing assembly 50; and two pressure tubes for connecting those inlets to suitable parts of the furnace. Examples of pressure sensing assemblies having such inlet fittings are showing in FIGS. 4A and 4B, which are simplified forms of FIG. 3, similarly functioning parts being similarly numbered, except for the addition of postscripts A and B.

The pressure sensing assembly of the invention may also be an assembly having one or more discrete pressure inlet fittings, and a diaphragm seal for isolating the interior of the sensing assembly against contact with the gasses whose pressures are being sensed. In the embodiment of FIGS. 1–3, for example, pressure inlet 57 may be closed off by a small flexible diaphragm seal 58 (shown in dotted lines in FIG. 3) through which connecting member 70 passes. Optionally, an additional pressure inlet may be provided. Examples of pressure sensing assemblies which have both discrete inlet fittings and a small flexible diaphragm seal of the type included in pressure sensing assemblies 50A and 50B of the embodiments of FIGS. 4A and 4B, which are provided with small flexible diaphragm seals 58A and 58B, respectively.

Figure 4A:
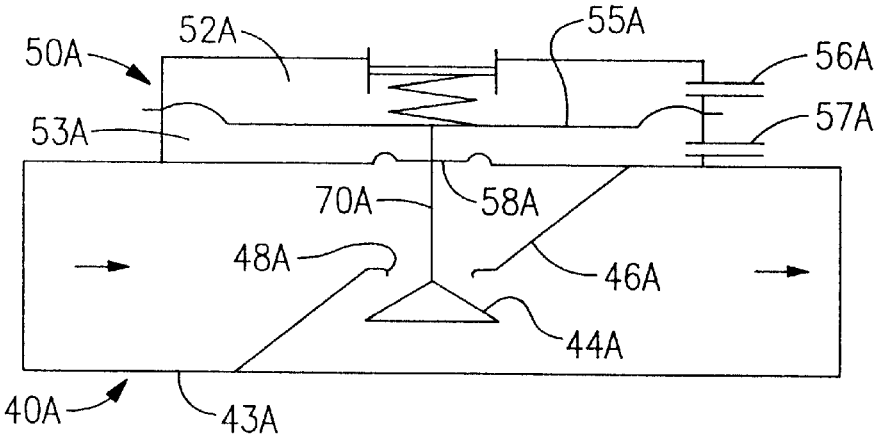
FIGS. 4A, 4B and 4C are simplified representations of alternative embodiments of the flow control assembly and pressure sensing assembly of the invention.
Figure 4B:
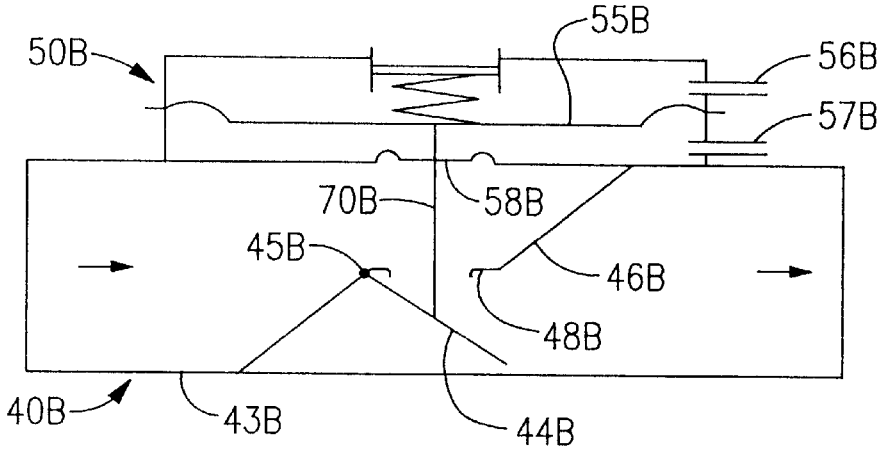
Figure 4C:
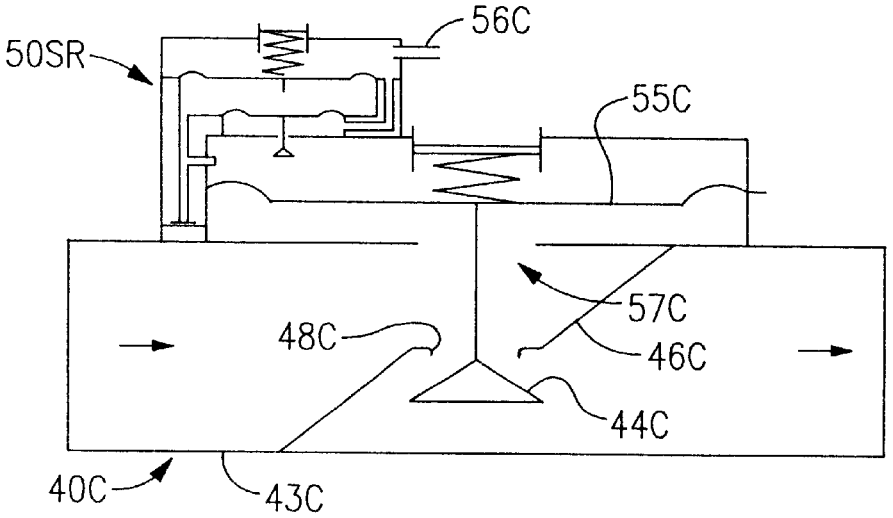

Referring to FIGS. 4A–4C there are shown three alternative embodiments of the invention, each of which includes a flow control assembly that includes a flow-through chamber or duct which is straight rather than bent through a right angle and which may therefore be used when access to the burner box or inducer assembly is more convenient. In FIG. 4A there is shown an embodiment of this type in which the movable restrictor member 44A slides rather than rotates toward and away from fixed restrictor member 46A, and takes the form of a poppet rather than a hinged plate. FIG. 4B shows an embodiment of this type in which the straight flow through chamber is used in combination with a movable restrictor member which uses a hinged plate rather than a poppet which is slidably mounted with respect to the fixed restrictor member. In both embodiments, the associated pressure sensing assembly is of the type which includes discrete pressure inlets and a connector arm which passes through a flexibly sealed opening in the sensing assembly sidewall.

Referring to FIG. 4C there is shown an embodiment of the invention which is similar to the embodiment of FIG. 4A, except that it includes a servo-regulator assembly 50SR in place of the pressure sensing assemblies used in the embodiments of FIGS. 1–3, 4A and 4B. The advantage of using this servo-regulator is that it allows the flow resistance established by flow control apparatus 40 to be controlled in a more precise manner. In all other respects, the operation of the embodiment of FIG. 4C is as described in connection with the embodiments of FIGS. 1–3, 4A and 413 and, accordingly, the embodiment of FIG. 4C will not be further discussed herein.

While the present invention has been described with reference to a number of specific embodiments, it will be understood that these embodiments are exemplary only and that the true spirit and scope of the present invention should be determined with reference to the following claims.

What is claimed is:

1. A combustion air regulating apparatus for use in an induced draft gas furnace which includes a combustion air intake, an exhaust vent, a burner box, a heat exchanger, and an inducer blower, and which has a first, low firing rate and a second, high firing rate, said combustion air regulating apparatus including, in combination:

an inducer motor for driving said inducer blower, said motor having a first, nominally fixed low speed and a second, nominally fixed high speed, and being of the type which has greater load-related speed fluctuations when it operates at said low speed than when it operates at said high speed;

a flow restrictor assembly disposed in fluidic series between the air intake and the exhaust vent for controllably restricting the flow of air through said burner box when the inducer motor operates at said low speed;

a pressure sensing assembly including a movable diaphragm having first and second sides and first and second pressure inputs that are in fluidic communication with respective ones of said sides;

first means for connecting said first pressure input to a part of the furnace which is at a pressure approximately equal to the pressure at an outlet end of the heat exchanger;

second means for connecting said second pressure input to a part of the furnace which is at a pressure approximately equal to the pressure at an inlet end of the heat exchanger; and a connecting member, coupled between said movable diaphragm and said flow restrictor assembly, for controllably restricting the flow of air between the air intake and the exhaust vent to maintain an approximately constant pressure drop across said heat exchanger when said motor operates at said low speed.

2. The combustion air regulating apparatus of claim 1 in which a flow resistance established by the flow restrictor assembly remains below a predetermined maximum value when the inducer motor operates at said low speed.

3. The combustion air regulating apparatus of claim 1 further including disabling means, responsive to the establishment of said high firing rate, for disabling said pressure sensing assembly, and thereby causing said flow restrictor assembly to establish its minimum resistance to the flow of air between said air intake and said exhaust vent.

4. The combustion air regulating apparatus of claim 3 in which said disabling means comprises a solenoid valve for blocking said first connecting means when the furnace operates in its high stage operating condition.

5. The combustion air regulating apparatus of claim 1 in which the furnace is a condensing furnace having a collector box for collecting water which condenses within said heat exchanger, and in which said first connecting means includes a pressure tube for connecting said first pressure input to said collector box.

6. The combustion air regulating apparatus of claim 1 in which said second connecting means is a pressure tube connecting said second pressure input to said heat exchanger in proximity to an inlet end thereof.

7. The combustion air regulating apparatus of claim 1 in which said second pressure input is an opening through a sidewall of said pressure sensing assembly, and in which said opening is in fluidic communication with said flow restrictor assembly.

8. The combustion air regulating apparatus of claim 7, further including a flexible diaphragm seal disposed in said opening.

9. The combustion air regulating apparatus of claim 1, further including a flexible diaphragm seal, disposed between said pressure sensing assembly and said connecting member, for fluidically isolating said movable diaphragm from air flowing through said flow restrictor assembly.

10. The combustion air regulating apparatus of claim 1 which said flow restrictor assembly includes an air duct, a first restrictor member movably mounted within said air duct, and a second, fixed restrictor member for cooperating with said first restrictor member to control the magnitude of the flow resistance which said flow restrictor assembly presents to combustion air flowing between said air intake and exhaust vent.

11. The combustion air regulating apparatus of claim 10 in which said first restrictor member is a plate-like member that is rotatably supported on a hinge that is positioned to one side of said second restrictor member, and in which said connecting member comprises a linkage which couples said diaphragm to said plate-like member.

12. The combustion air regulating apparatus of claim 11 in which said air duct includes first and second end sections having longitudinal axes that are disposed at an approximately right angle with respect to one another, and an intermediate section disposed between said first and second end sections, in which said pressure sensing assembly is positioned in proximity to said intermediate section, and in which said diaphragm and said second restrictor member are oriented roughly perpendicular to one of said longitudinal axes.

13. The combustion air regulating apparatus of claim 10 in which said first restrictor member is a poppet member slidably supported within said duct, in which said pressure sensing assembly is positioned adjacent to a sidewall of said duct, and in which the diaphragm of said sensing assembly is coupled to move said poppet member toward and away from said second restrictor member.

14. The combustion regulating apparatus of claim 13 in which the duct of said restrictor assembly is a straight duct and in which said second restrictor member is disposed in a plane generally parallel to the longitudinal axis of said straight duct.

15. The combustion air regulating apparatus of claim 13 in which the pressure sensing assembly is coupled to said connecting member through a flexible diaphragm seal that isolates the diaphragm of said sensing assembly from the air within said duct.

16. A combustion air regulating apparatus for use in an induced draft gas furnace which includes a combustion air intake, an exhaust vent, a burner box, a heat exchanger, and an inducer blower, and which has one or more firing rates, said combustion air regulating apparatus including, in combination:

an inducer motor for driving said inducer blower, said motor having one or more nominally fixed operating speeds which correspond to said one or more firing rates, and being of a type which operates at a speed that is relatively poorly regulated when said motor operates at at least its lowest operating speed;

flow control means located in fluidic series between said combustion air intake and said exhaust vent for controllably varying the rate of flow of combustion air through said burner box when said motor operates at at least its lowest operating speed;

pressure responsive means for controlling said flow control means in accordance with the pressure at at least an outlet end of the heat exchanger, said pressure responsive means having at least one inlet and a movable diaphragm having a first side that is in fluidic communication with said at least one inlet;

means for connecting said at least one inlet to a location within the furnace which is at a pressure that approximates the pressure at the outlet end of the heat exchanger; and a coupling member, connected between said diaphragm and said flow control means, to assure that variations in the pressure across the heat exchanger cause said flow control means to vary said rate of flow and thereby maintain an excess air level within the burner box at an approximately constant value when said motor operates at at least its lowest operating speed.

17. The combustion air regulating apparatus of claim 16 in which the flow control means maintains a resistance which it presents to the flow of combustion air below a predetermined maximum value when said motor operates at its lowest operating speed.

18. The combustion air regulating apparatus of claim 16 in which said furnace has at least two firing rates, further including disabling means, connected to the pressure responsive means and responsive to the operation of the furnace at at least one firing rate higher than its lowest firing rate, for causing said flow control means to establish a condition of minimum resistance to the flow of combustion air.

19. The combustion air regulating apparatus of claim 18 in which said disabling means comprises a solenoid valve, fluidically coupled to said pressure responsive means, for preventing said pressure responsive means from controlling said flow control means when the furnace operates at at least one firing rate which is higher than its lowest firing rate.

20. The combustion air regulating apparatus of claim 16 in which the furnace is a condensing furnace having a collector box for collecting water that condenses within said heat exchanger, and in which said location which is at a pressure that approximates the pressure at an outlet end of the heat exchanger is said collector box.

21. The combustion air regulating apparatus of claim 16 in which said pressure responsive means includes a second inlet, further including connecting means for connecting said second inlet to a location in proximity to an inlet end of the heat exchanger.

22. The combustion air regulating apparatus of claim 16 in which said pressure responsive means includes a second inlet comprising an opening in said pressure responsive means through which a second side of said diaphragm is maintained in fluidic communication with the interior of said flow control means.

23. The combustion air regulating apparatus of claim 22 further including a flexible diaphragm seal positioned in said opening, in which said coupling member is a control arm that is connected to said flow control means through said flexible diaphragm seal.

24. The combustion air regulating apparatus of claim 16 in which said flow control means includes an air duct, a first restrictor member movably mounted within said air duct, and a second, fixed restrictor member for cooperating with the first restrictor element to controllably restrict the flow of air through said air duct.

25. The combustion air regulating apparatus of claim 24 in which said coupling member is a control arm, and in which the diaphragm of said pressure responsive means is connected to said control arm through a flexible diaphragm seal that at least partially isolates the diaphragm of said pressure responsive means from the combustion air within said air duct.

26. The combustion air regulating apparatus of claim 24 in which said first restrictor member comprises a plate-like element that is supported on a hinge positioned to one side of said second restrictor member, and in which said coupling member comprises a control arm disposed between said plate-like element and said movable diaphragm.

27. The combustion air regulating apparatus of claim 26 in which said air duct includes first and second end sections having longitudial axes that are disposed at an approximately right angle with respect to one another, and an intermediate section disposed between said first and second end sections, in which said pressure responsive means is positioned in proximity to said intermediate section, and in which said movable diaphragm and said second restrictor member are oriented roughly perpendicular to one of said longitudinal axes.

28. The combustion air regulating apparatus of claim 24 in which said first restrictor member is a poppet member that moves toward and away from said second restrictor member, in which said pressure responsive means is positioned adjacent to said air duct, and in which said coupling member is a control arm disposed between said diaphragm and said poppet member.

29. The combustion air regulating apparatus of claim 28 in which said air duct is relatively straight, and in which said second restrictor member defines an opening that lies in a plane generally parallel to the longitudinal axis of said air duct.

30. The combustion air regulating apparatus of claim 28 in which said pressure responsive means is connected to said control arm by a flexible diaphragm seal that at least partially isolates said diaphragm from the air within said duct.

* * * * *